US011166531B2

(12) United States Patent
Seminara

(10) Patent No.: US 11,166,531 B2
(45) Date of Patent: Nov. 9, 2021

(54) ADJUSTABLE SECURING ARRANGEMENT FOR SECURING AN OBJECT WITHIN A LUGGAGE ARTICLE

(71) Applicant: Samsonite IP Holdings S.a r.l., Luxembourg (LU)

(72) Inventor: Michele Seminara, Gorla Minore (IT)

(73) Assignee: Samsonite IP Holdings S.a r.l., Luxembourg (LU)

( * ) Notice: Subject to any disclaimer, the term of this patent is extended or adjusted under 35 U.S.C. 154(b) by 514 days.

(21) Appl. No.: 15/923,264

(22) Filed: Mar. 16, 2018

(65) Prior Publication Data

US 2018/0263344 A1 Sep. 20, 2018

(30) Foreign Application Priority Data

Mar. 17, 2017 (EP) ..... 17161507

(51) Int. Cl.
*A45C 5/03* (2006.01)
*A45C 11/00* (2006.01)
*A45C 13/02* (2006.01)

(52) U.S. Cl.
CPC ..... *A45C 5/03* (2013.01); *A45C 11/00* (2013.01); *A45C 13/02* (2013.01); *A45C 2011/003* (2013.01); *A45C 2013/025* (2013.01)

(58) Field of Classification Search
CPC ... A45C 13/30; A45C 13/02; A45C 2011/003; A45C 2013/025; A45C 5/03;
(Continued)

(56) References Cited

U.S. PATENT DOCUMENTS 4,573,573 A 3/1986 Favaro
5,159,729 A * 11/1992 Walker ..... B60P 7/083 24/302

(Continued)

FOREIGN PATENT DOCUMENTS

CN 202404489 U 8/2012
CN 204930641 U 1/2016

(Continued)

OTHER PUBLICATIONS

Extended European Search Report of European Patent Application No. 17161507.3, dated Jul. 3, 2017, 5 pages.

*Primary Examiner* — Sue A Weaver
(74) *Attorney, Agent, or Firm* — Dorsey & Whitney LLP

(57) ABSTRACT

An adjustable securing arrangement for securing an object within a luggage article is provided. The securing arrangement may include opposing front and rear panels, a turnbuckle, and at least one flexible strap extending from one of the front and rear panels and at least partially through the turnbuckle to then be releasably secured to the one of the front and rear panels. Each strap may include a first portion arranged to extend around at least one side of the object, and a second portion arranged to extend over a top side of the object. The turnbuckle may redirect each strap such that the first portion extends at an angle (α) to the second portion. The first and second portions may be adjusted simultaneously relative to the turnbuckle by a user pulling a distal end of each strap to secure or release the object between the front and rear panels.

16 Claims, 7 Drawing Sheets

(58) Field of Classification Search
CPC ..... A45C 11/00; A45C 13/005; A45C 13/103; A45C 13/1092
USPC ..... 206/293, 320
See application file for complete search history.

(56) References Cited

U.S. PATENT DOCUMENTS

| | | | | |
|---|---|---|---|---|
| 5,529,184 | A | 6/1996 | Sadow | |
| 5,762,170 | A | 6/1998 | Shyr et al. | |
| 6,105,764 | A * | 8/2000 | Scicluna | A45C 13/02 190/111 |
| 6,604,618 | B1 | 8/2003 | Godshaw et al. | |
| 6,739,754 | B2 * | 5/2004 | Moor | A45C 11/34 190/102 |
| 7,036,642 | B2 | 5/2006 | Hoberman et al. | |
| D531,409 | S | 11/2006 | Tuellmann et al. | |
| 7,293,649 | B2 | 11/2007 | Gelphman et al. | |
| 7,487,896 | B2 | 2/2009 | Howard, Jr. et al. | |
| 7,540,378 | B2 | 6/2009 | Gallagher | |
| 7,556,448 | B2 * | 7/2009 | Hu | F16B 7/06 403/43 |
| 7,625,048 | B2 | 12/2009 | Rouhana et al. | |
| 7,980,780 | B2 * | 7/2011 | Hartlemeier | F16B 7/06 114/109 |
| 9,210,976 | B2 | 12/2015 | Maeda | |
| 2007/0246386 | A1 | 10/2007 | Nykoluk et al. | |
| 2008/0202958 | A1 | 8/2008 | Hanlen et al. | |
| 2009/0230006 | A1 | 9/2009 | Pidgley | |
| 2010/0089778 | A1 | 4/2010 | Park | |
| 2012/0125956 | A1 | 5/2012 | Maeda | |
| 2015/0109279 | A1 * | 4/2015 | Gupta | G09G 3/3233 345/211 |
| 2015/0359307 | A1 * | 12/2015 | Kandel | A45C 11/00 190/109 |
| 2016/0003581 | A1 * | 1/2016 | Warren | A41D 13/055 2/2.5 |
| 2016/0070312 | A1 * | 3/2016 | Stackhouse | G06F 1/1607 361/679.31 |
| 2017/0160053 | A1 * | 6/2017 | Chavira | A45C 13/10 |

FOREIGN PATENT DOCUMENTS

| | | |
|---|---|---|
| CN | 205813910 U | 12/2016 |
| CN | 208243131 U | 12/2018 |
| EP | 3375318 B1 | 10/2019 |

* cited by examiner

FIG. 8
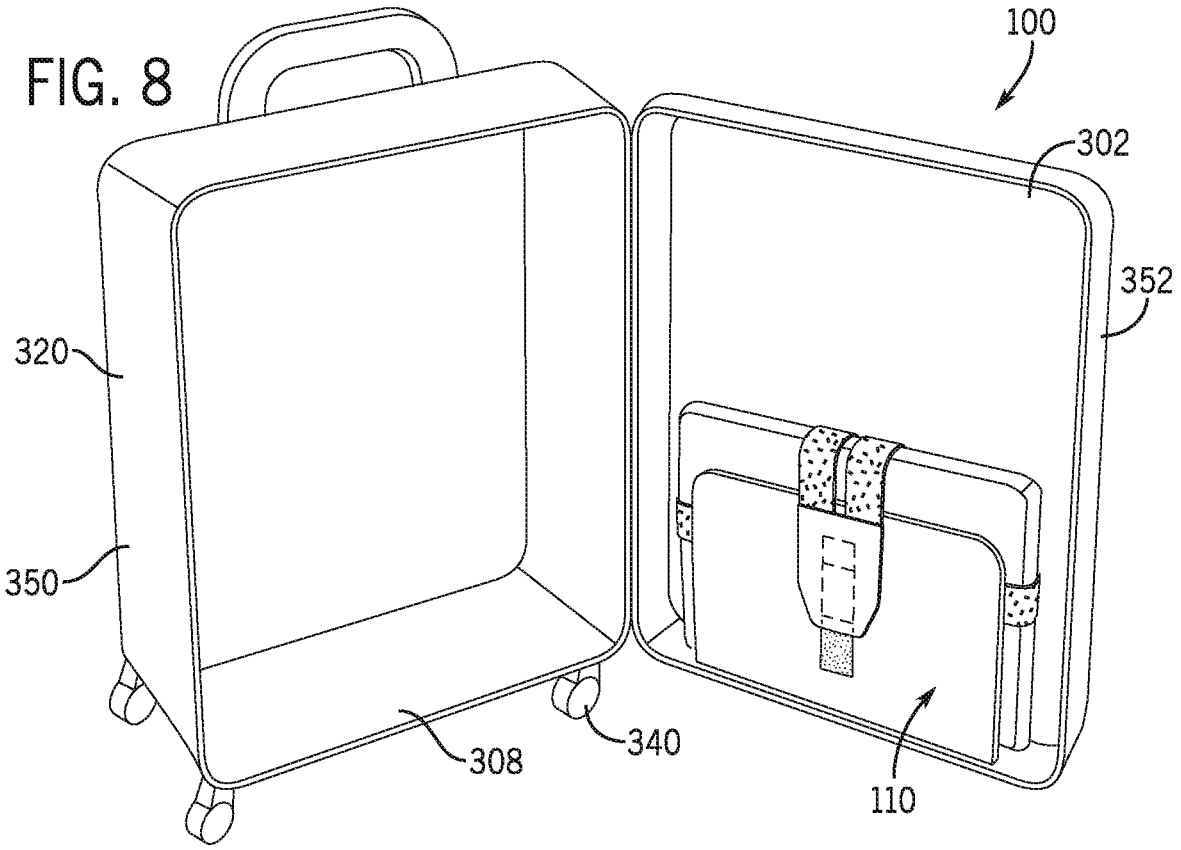
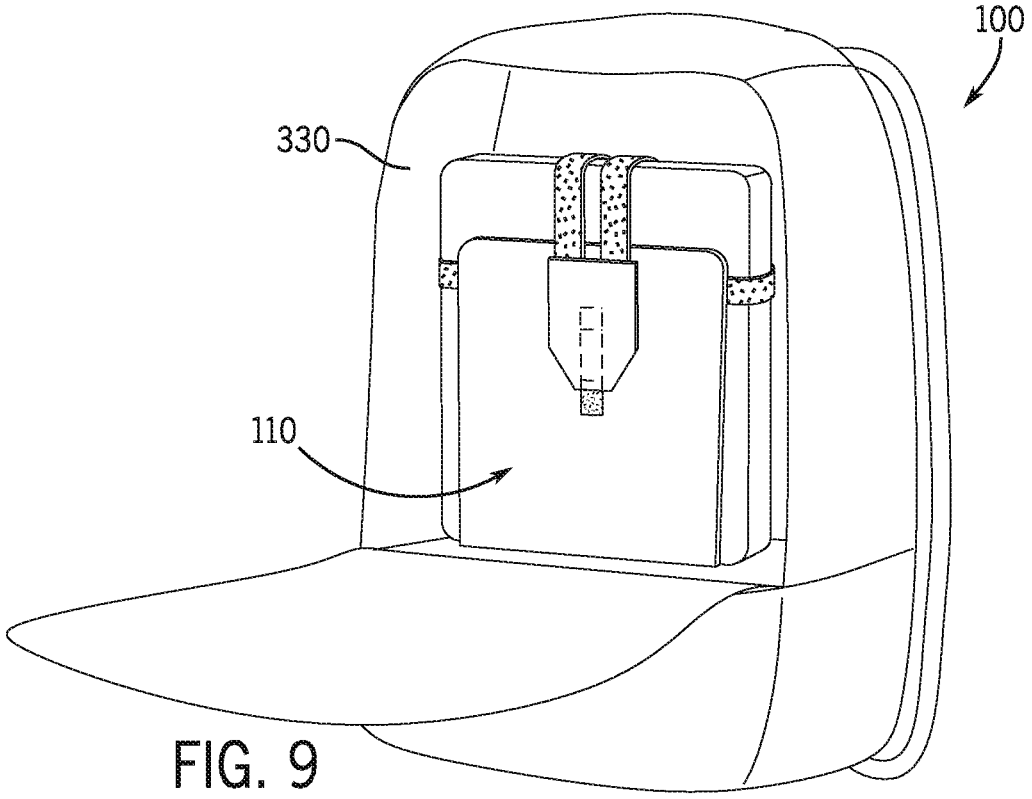
FIG. 9

ADJUSTABLE SECURING ARRANGEMENT FOR SECURING AN OBJECT WITHIN A LUGGAGE ARTICLE

CROSS-REFERENCE TO RELATED APPLICATION

This application claims priority to European Patent Application No. 17161507.3, filed Mar. 17, 2017, entitled "Adjustable Securing Arrangement For Securing an Object Within a Luggage Article", which is hereby incorporated by reference herein in its entirety for all purposes.

TECHNICAL FIELD

The present disclosure relates generally to luggage articles, and more specifically to an adjustable securing arrangement for securing an object within a luggage article.

BACKGROUND

Some luggage articles include an adaptable storage compartment or arrangement to adaptably secure objects, in particular laptop or tablet computers, therein. Unfortunately, the objects may have varied dimensions and typical storage arrangements require multiple actions to adapt the compartment to the dimensions of the object to be secured, which may deter a user from properly securing the object within the luggage article. Additionally, the adaptable storage arrangement may be too complex quickly and easily secure an object within the luggage.

It is therefore desirable to provide an improved adjustable securing arrangement, and more specifically an improved securing arrangement that adjustably secures an object within a luggage article, that addresses one or all of the above described problems and/or which more generally offers improvements or an alternative to existing arrangements.

Documents that may be related to the present disclosure in that they include various adjustable storage compartments include US921097662, US20100089778A1, US20080202958A1, US20070246386A1, U5754037862, US20090230006A1, USD531409S, U5748789662, U5729364962, U5703664262, U5660461861, U.S. Pat. Nos. 5,762,170A, 5,529,184A, and 4,573,573A.

SUMMARY

The present disclosure provides an adjustable securing arrangement configured to adjustably secure an object within a luggage article, as described below and defined in the accompanying claims. The present disclosure advantageously provides a securing arrangement that can be easily adapted or adjusted to secure objects of various sizes within an interior storage compartment of a luggage article. The securing arrangement includes at least one flexible securing member (e.g., a strap) and an adjustment mechanism (e.g., a turnbuckle) arranged to direct different portions of the at least one securing member around different portions of an object to be secured. The different portions of the at least one securing member are adjusted simultaneously relative to the adjustment mechanism to secure or release the object.

Embodiments of the present disclosure may include an adjustable securing arrangement configured to secure an object within a luggage article. The securing arrangement may include opposing front and rear panels, a turnbuckle, and at least one flexible strap extending from one of the front and rear panels and at least partially through the turnbuckle to then be releasably secured to the one of the front and rear panels. Each strap may include a first portion arranged to extend around at least one side of the object, and a second portion arranged to extend over a top side of the object. The turnbuckle may redirect each strap such that the first portion extends at an angle to the second portion. The first and second portions may be adjusted simultaneously relative to the turnbuckle by a user pulling a distal end of each strap to secure or release the object between the front and rear panels.

In some embodiments, the turnbuckle may direct each strap through the angle to position each strap around adjacent sides of the object.

In some embodiments, the turnbuckle may be coupled to the rear panel. Each strap may extend from the front panel with a distal end of each strap releasably attached to the front panel. The rear panel may be formed as part of the luggage article. The front panel may be a flap-like member extending from adjacent the bottom of the object.

In some embodiments, each strap may be at least partially resiliently extendable.

In some embodiments, pulling the distal end of each strap may tighten each strap against at least one side of the object and may move at least one of the front and rear panels against the object.

In some embodiments, the first portion may extend at a perpendicular angle to the second portion.

In some embodiments, each strap may include two straps, the first portion of each strap at least partially extending in respective opposing directions around opposing sides of the object. The distal ends of each strap may be joined together and attached together to the front panel.

In some embodiments, the turnbuckle may include at least one first channel portion and at least one second channel portion defined therein, the first and second channel portions extending at an angle relative to each other. The first portion of each strap may extend within a first channel portion. The second portion of each strap may extend within a second channel portion to direct the first and second portions of each strap through the angle. A slot may be defined through the turnbuckle to connect first and second channel portions defined on opposing sides of the turnbuckle together. Each strap may be threaded through a slot in extending within the first and second channel portions.

Embodiments of the present disclosure may include a luggage article including the adjustable securing arrangement of any embodiment described above. The luggage article may include a housing defining an internal storage compartment, and including a rear wall, a front wall opposite the rear wall, a plurality of side walls extending between the front and rear walls, and an opening allowing access to the internal storage compartment. The adjustable securing arrangement may be associated with the housing to adjustably secure the object within the internal storage compartment.

In some embodiments, the rear panel of the adjustable securing arrangement may include at least part of the rear wall of the housing.

In some embodiments, the front panel of the adjustable securing arrangement may be hingedly coupled to one of the walls of the housing, preferably to the rear wall or to a bottom wall of the housing.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various embodiments of the disclosure and should not be construed as a complete recitation of the scope of the disclosure, characterized in that:

FIG. 8 is an isometric view of the adjustable securing arrangement associated with a luggage case in accordance with another example of the present disclosure.

FIG. 9 is an isometric view of the adjustable securing arrangement associated with a backpack—in accordance with a further example of the present disclosure.

DETAILED DESCRIPTION

Figure 1:
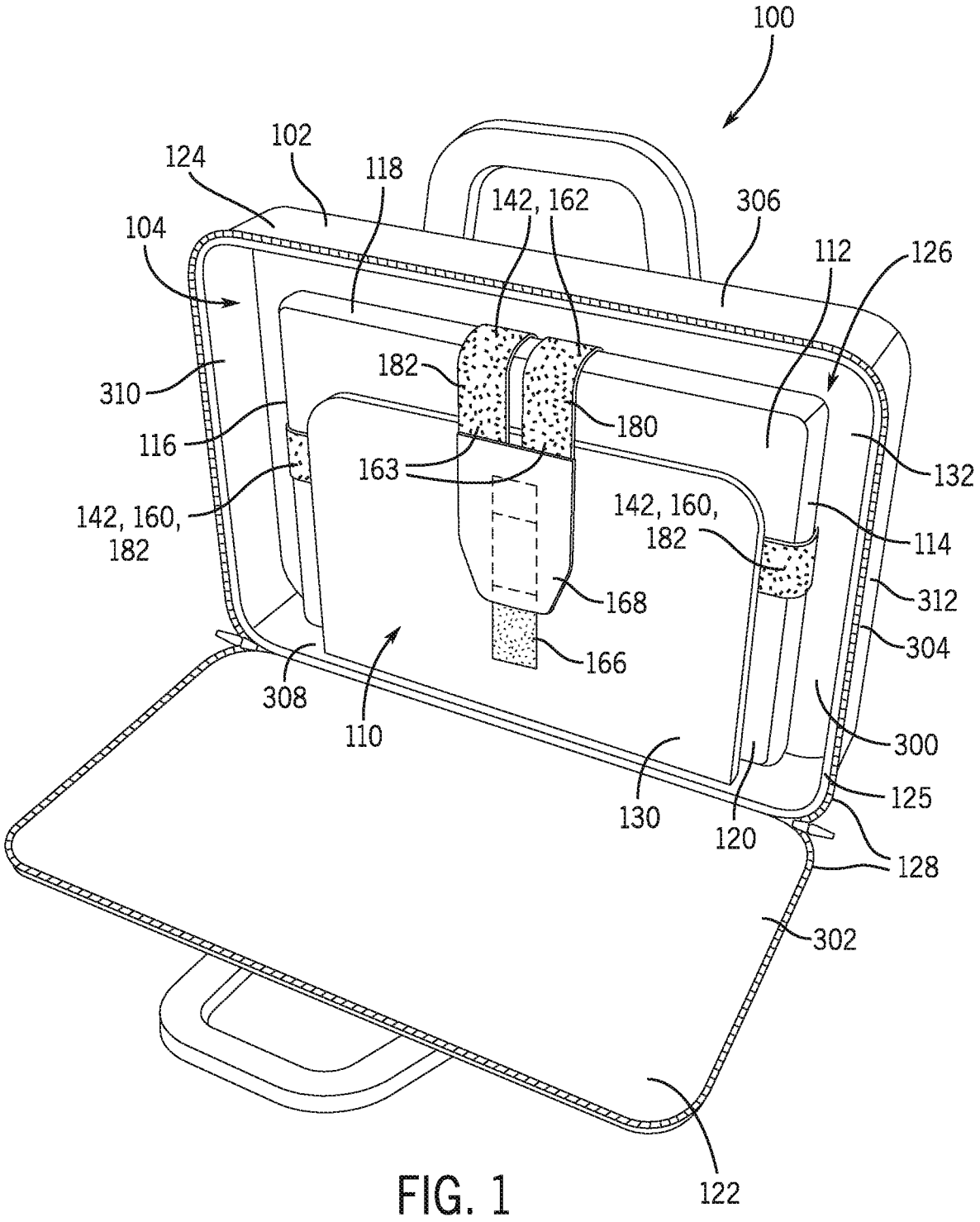
FIG. 1 is a front isometric view of a luggage article including a laptop secured therein via an adjustable securing arrangement in accordance with some examples of the present disclosure.

According to the present disclosure, an adjustable securing arrangement is provided that is configured to secure or release an object using a single action. As explained below, the securing arrangement may be operable to quickly and easily secure or release an object within a luggage article. The securing arrangement includes at least one flexible securing member, such as a strap in one example, and an adjustment mechanism, such as a turnbuckle in one example, arranged to direct different portions of the at least one securing member around different portions of the object, the different portions of the at least one securing member being adjusted simultaneously relative to the adjustment mechanism to secure or release the object.

According to an embodiment of the present disclosure, a luggage article 100 includes a housing 102 formed from a plurality of walls or panels defining an internal storage compartment 104 and a storage volume in which to carry a user's belongings. As described herein, the luggage article 100 includes an adjustable securing arrangement 110 associated with the housing 102 and configured to adjustably secure an object 112 within the internal storage compartment 104 of the luggage article 100. Though the figures show a laptop secured within the luggage article 100 via the securing arrangement 110, the object 112 may be substantially any item a user desires to secure within the luggage article 100, such as an electronic device (e.g., tablet, portable gaming system, etc.), a book, a binder, or a smaller piece of luggage (e.g., a briefcase, purse, storage sleeve, etc.), among others. For ease of reference, however, the following description describes the object 112 as a laptop for illustration purposes, the laptop including opposing first and second sides 114, 116 and opposing third and fourth sides 118, 120 defining the perimeter of the laptop. In addition, though shown and described as a briefcase, the luggage article 100 may take on any form or shape, including a spinner case, a backpack, or the like, as explained more fully below.

The luggage article 100 may be transformable between a closed configuration and an open configuration. For example, the luggage article 100 may include a lid 122 pivotably attached to a base 124 along a split line 125 (e.g., via a hinge structure or similar mechanism) to define a selective opening 126 allowing access to the internal storage compartment 104 (see FIGS. 1 and 2). In such embodiments, the lid and base 122, 124 may be pivoted towards or away from each other to close or open the luggage article 100, respectively. The hinge structure may be a fabric strip, a piano hinge, a living hinge, spaced-apart discrete hinges, a zipper structure, or an articulating joint made of elastomeric material or the like, among others. Depending on the particular application, the luggage article 100 may include a closure mechanism 128. The closure mechanism 128 may be secured along the peripheral edges of the lid 122 and the base 124 to allow selective user actuation for opening and closing of the luggage article 100. In the open configuration, the closure mechanism 128 may be disengaged along substantially the entire length of the split line 125, allowing the lid 122 and the base 124 to pivot relative to each other to any amount from partially open to fully open. In the closed configuration, the closure mechanism 128 may be engaged along substantially the entire length of the split line 125 to secure the lid 122 to the base 124 and limit removal of the object 112 from the luggage article 100. The closure mechanism 128 is disclosed herein primarily as a zipper closure, although any other suitable type of closure mechanisms may be utilized.

Figure 2:
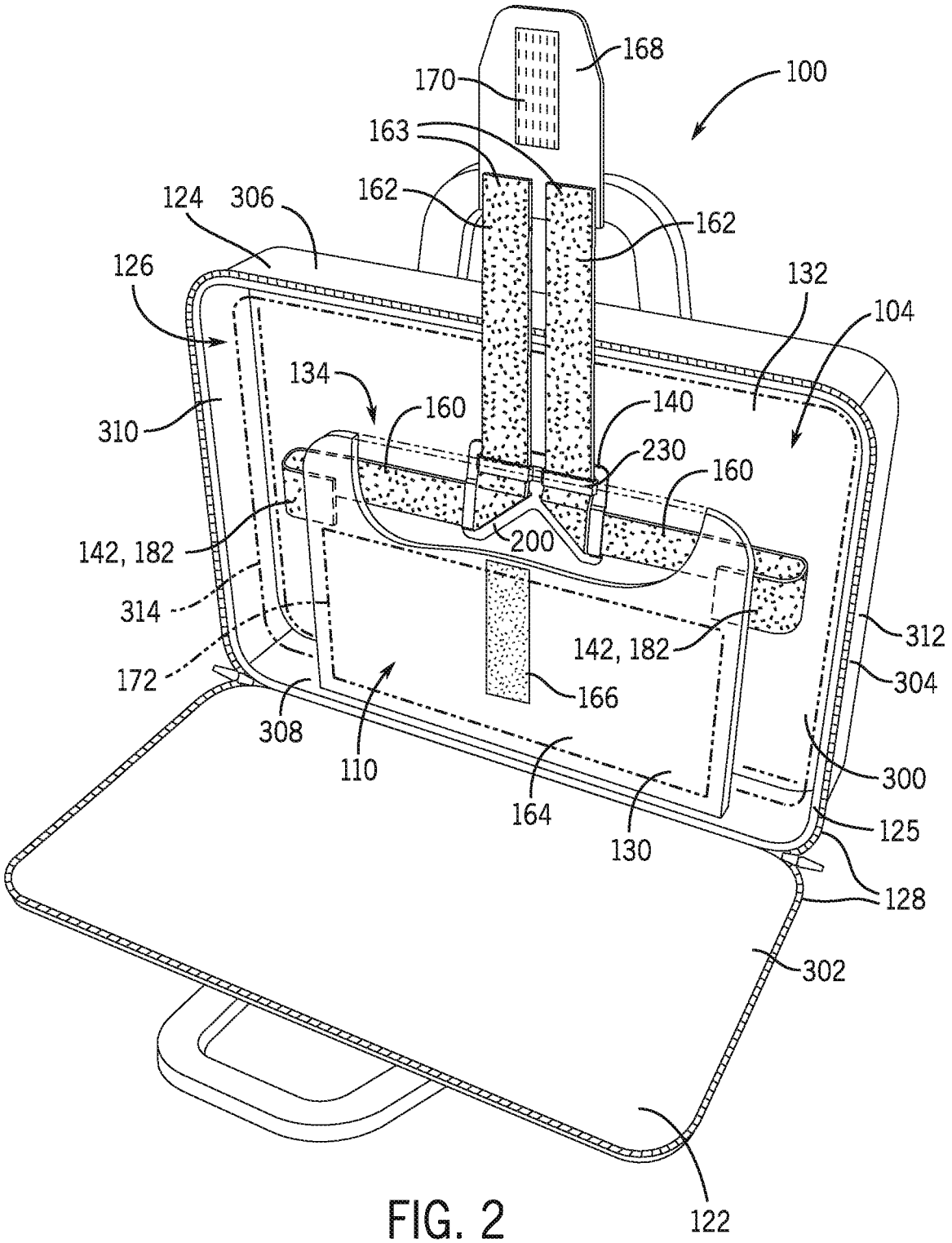
FIG. 2 is a front isometric view of the luggage article of FIG. 1 with the laptop removed in accordance with some examples of the present disclosure.

In one embodiment, illustrated in FIG. 2, the securing arrangement 110 includes opposing front and rear panels 130, 132 defining a space 134 therebetween in which to at least partially position the object 112 for securement. Preferably, the front and rear panels 130, 132 are attached to or at least partially define one of the plurality of walls or panels of the luggage article 100, as explained below. For instance, in one example, at least one of the front and rear panels 130, 132 (e.g., the rear panel 132) may be formed as part of the luggage article 100, such as including the lid 122 or the base 124.

As described herein, the securing arrangement 110 may be operable to secure and release the object 112 between the front and rear panels 130, 132. For example, the securing arrangement 110 may include an adjustment mechanism, such as for example a turnbuckle 140 (hereinafter "turnbuckle" for the sake of convenience without intent to limit). In one embodiment, the turnbuckle 140 may be adjacent to (e.g., by being coupled to) one of the front and rear panels 130, 132 (e.g., adjacent and/or coupled to the rear panel 132). In one embodiment, the securing arrangement 110 may include at least one securement member, such as for example a strap 142, (hereinafter "strap" for the sake of convenience without intent to limit) associated with the turnbuckle 140. A portion of each strap 142 may be coupled to one of the front and rear panels 130, 132 (e.g., to the front panel 130). In one embodiment, each strap 142 may extend from one of the front and rear panels 130, 132 (e.g., from the front panel 130) and at least partially through the turnbuckle 140 to then be releasably secured to the same one of the front and rear panels 130, 132, as described more fully below. Each strap 142 may include at least a portion of its length that is flexible, or may be flexible along its entire length. Although referred to as a "panel," at least one of the front and rear panels 130, 132 (e.g., the front panel 130) may be formed as a flap-like or a strap-like member. For example, the front panel 130 may be a flap extending from adjacent the bottom of the object 112 to be coupled with the strap 142.

The turnbuckle 140 may direct each strap 142 around the object 112 to secure the object 112 within the luggage article 100. For example, the turnbuckle 140 may be arranged to direct different portions of each strap 142 around different sides or portions of the object 112 to adjustably secure the object 112 between the front and rear panels 130, 132 (see FIG. 1). For example, each strap 142 may be arranged to extend from the front panel 130 around a portion of the object 112 to the turnbuckle 140, and from the turnbuckle 140 around another portion of the object 112 to the front panel 130 to adjustable secure the object 112 within the luggage article 100 (see FIG. 6), as described more fully below. In some embodiments, at least portions of the securing arrangement 110 may be configured to limit damage of the object 112 during transit. For instance, the front and rear panels 130, 132 may be padded. Additionally or alternatively, portions of the securing arrangement 110, such as the front and rear panels 130, 132, the turnbuckle 140, the strap 142, or any combination thereof, may be formed from or lined with a material operable to limit scratching of or otherwise damage to the object 112 (e.g., felt, microfiber, soft fabric, rubber, plastic, etc.).

In one non-limiting example, each strap 142 includes a first portion 160 arranged to extend around at least one side of the object 112, and a second portion 162 arranged to extend around another side of the object 112. For example, the first portion 160, which may be referred to as a horizontal or lateral portion, may extend (e.g., laterally) from a side of the front panel 130 to extend around (e.g., horizontally around) at least the first side 114 of the object 112 (e.g., around a lateral side of the object 112) to the turnbuckle 140. The lateral side of the object 112 in one example may extend vertically when the object 112 is positioned within the luggage article 100 and the luggage article 100 is orientated in an upright configuration. The second portion 162, which may be referred to as an upper or vertical portion, may extend from the turnbuckle 140 around (e.g., vertically around) at least the third side 118 of the object 112 (e.g., around an adjacent side of the object 112 such as over the top or top side of the object 112) to the front panel 130 to then have its distal end 163 attach and be secured (e.g., releasably attached) to the front panel 130 (see FIG. 1).

In various embodiments, at least one of the first and second portions 160, 162 may be releasably attachable to the front panel 130 to releasably secure the object 112 within the luggage article 100. For instance, the first portion 160 may be fixed to a side of the front panel 130 (e.g., via stitching, fasteners, or the like), with the second portion 162 releasably attached to the front panel 130, such as via a hook-and-loop fastener, as explained below. For example, an exterior surface 164 of the front panel 130 may include a first part 166 of a hook-and-loop fastener (see FIG. 2). In such embodiments, the second portion 162, and preferably a flap 168 connected to the distal end 163 of the second portion 162, includes a second part 170 of the hook-and-loop fastener such that engagement of the first and second parts 166, 170 of the hook-and-loop fastener releasably secures each strap 142 (e.g., the second portion 162 of each strap 142) to the front panel 130. The arrangement of the hook-and-loop fastener permits the flap 168 to be secured to the front panel 130 at substantially any position to accommodate for various-sized objects, as explained below. For example, the flap 168 may be secured along a length (e.g., a height) of the front panel 130, such as along a length of the first part 166 of the hook-and-loop fastener. Though a hook-and-loop fastener having first and second parts 166, 170 is described above, the securing arrangement 110 may include other configurations to releasably attach at least one of the first and second portions 160, 162 to the front panel 130. For example, and without limitation, the front panel 130 may be covered by a material, such as a fleece-type material, (hereinafter covering 172 for the sake of convenience without intent to limit) that allows the flap 168 to be secured at any position on the front panel 130 (see FIG. 2). For instance, the second part 170 of the hook-and-loop fastener may releasably engage the covering 172 to secure the flap 168 to the front panel 130 and at substantially any position on the front panel 130.

In a preferred embodiment, at least a portion of at least one strap 142, or at least a portion of each strap 142, is resiliently extendable, which may allow slight movement of the object 112 within the luggage article 100 and/or provide a securing force against the object 112. Additionally or alternatively, the resiliently extendable characteristic of each strap 142 may permit enlargement of the space 134 between the front and rear panels 130, 132 without movement of the strap(s) 142 through the turnbuckle 140. The resiliently extendable characteristic of each strap 142 may bias at least portions of each strap 142 against the object 112 (when the flap 168 is engaged to the front panel 130) or towards the rear panel 132 (when the flap 168 disengages the front panel 130). In some embodiments, each strap 142 is a cord or a strap (or in some non-limiting instances may be a cable). In another example, at least a portion of at least one strap is resiliently extendable. In another example, at least a portion of at least one strap may be non-extendable, and in a further example at least one strap, or each strap, may be non-extendable.

Preferably, the securing arrangement 110 may include two straps (e.g., a first strap 180 and a second strap 182), each of the two straps 180, 182 configured substantially identically to each other (albeit in a mirrored configuration in some embodiments) and operate cooperatively in opposing side directions to secure the object 112 there between. In embodiments having two or more straps, the securing arrangement 110 may be configured such that one or more straps extend around opposing sides of the object 112 (see FIG. 1). In embodiments having two straps, the first portion 160 of each strap may at least partially extend in respective opposing directions around opposing sides of the object 112. For example, at least a portion of the first strap 180 (e.g., the first portion 160 of the first strap 180) may extend around the first side 114 of the object 112, and at least a portion of the second strap 182 (e.g., the first portion 160 of the second strap 182) may extend around the second side 116 of the object 112 (see FIG. 1). In such embodiments, the second portions 162 of the first and second straps 180, 182 may extend around the third side 118 of the object 112, such as adjacent (and in further example parallel) to each other. In one embodiment, the second portions 162 of the first and second straps 180, 182 may each be connected to the flap 168 such that movement of the flap 168 moves the first and second straps 180, 182 simultaneously, as explained below.

Though shown and described as including two straps, the securing arrangement 110 may include just one strap. For example, the single strap (e.g., one of the first or second straps 180 or 182) may extend around the first and third sides 114, 118 of the object 112 to secure the object between the front and rear panels 130, 132. In such embodiments, the securing arrangement 110 may include additional structure limiting undesired removal of the object 112. In one example, at least a portion of the front panel 130 may be coupled (e.g., attached and in further example stitched or otherwise fastened) to the rear panel 132 adjacent the second side 116 of the object 112. For example, one side of the front panel 130 may be stitched, fastened, or otherwise attached to the rear panel 132 to define a sleeve in which the object 112 may be partially inserted and secured via the securing arrangement 110.

As described herein, the turnbuckle 140, which may be referred to as a adjustment member, an adjustment clip, or the like, may include directional features configured to direct extension of each strap 142 around the different sides of the object 112. For example, extension of each strap 142 through the turnbuckle 140 may define or otherwise direct the first and second portions 160, 162 of each strap 142, such as the first portion 160 continuing through the turnbuckle 140 to define the second portion 162. As described herein, the turnbuckle 140 may redirect each strap 142 such that the first portion 160 extends at an angle $\alpha$ to the second portion 162. In one embodiment, illustrated in FIGS. 2 and 3, the turnbuckle 140 may include first and second channel portions 190, 192 defined therein, such as a plurality of first channel portions 190 and a plurality of second channel portions 192. The first and second channel portions 190, 192 may extend at an angle $\alpha$ relative to each other to direct each strap 142 through the angle $\alpha$ to position each strap 142 (e.g., the first and second portions 160, 162 of each strap 142) around different (e.g., adjacent) sides of the object 112. In such embodiments, the first portion 160 of each strap 142 may extend within a first channel portion 190, and the second portion 162 of each strap 142 may extend within a corresponding second channel portion 192 to direct the first and second portions 160, 162 of each strap 142 through the angle $\alpha$. The first and second channel portions 190, 192 may be angularly arranged such that the turnbuckle 140 directs each strap 142 through a 90 degree, less than 90 degree, or greater than 90 degree angle. For example, the turnbuckle 140 may direct each strap 142 through an angle (preferably a 90 degree angle) to extend the second portion 162 of each strap 142 substantially perpendicular to the first portion 160, though other configurations are contemplated, as described below.

Figure 3:
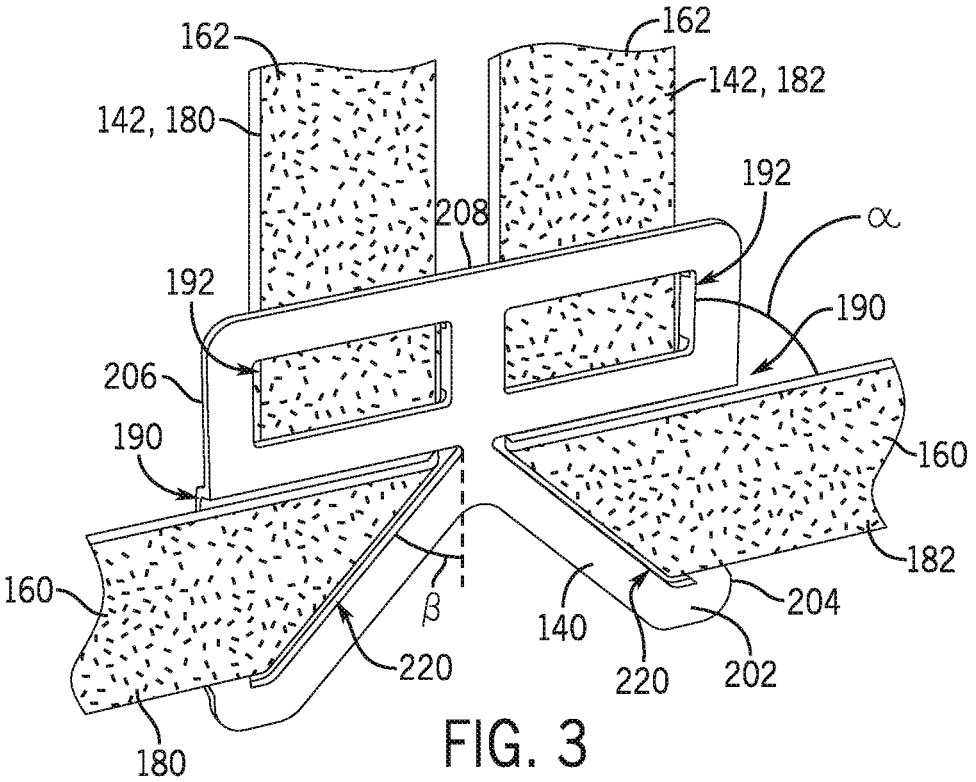
FIG. 3 is an enlarged more detailed rear isometric view of an adjustment mechanism and straps threaded therethrough of the adjustable securing arrangement in accordance with some examples of the present disclosure.

In one embodiment, illustrated in FIGS. 2 and 3, the turnbuckle 140 includes opposing front and rear surfaces 200, 202, opposing left and right edges 204, 206, and a top edge 208. In such embodiments, the rear surface 202 of the turnbuckle 140 may be coupled to the rear panel 132, such as positioned in a facing or abutting relationship to the rear panel 132 depending on the particular application. Each first channel portion 190 may be defined in the rear surface 202 of the turnbuckle 140, such as recessed from a nominal plane defined by the rear surface 202. As shown, each first channel portion 190 may extend inward from a respective left or right edge 204 or 206 of the turnbuckle 140, each first channel portion 190 terminating at a slot 220 defined through the turnbuckle 140. As described more fully below, each slot 220 may extend at an angle $\beta$ (e.g., about 45 degrees, less than 45 degrees, or greater than 45 degrees) to at least one of the first and second channel portions 190, 192 (e.g., to both the first and second channel portions 190, 192) to direct an associated strap 142 from the first channel portion 190 towards the second channel portion 192, such as through the angle $\alpha$.

Each second channel portion 192 may be defined on the front surface 200 of the turnbuckle 140. In such embodiments, the slot 220 may connect each first channel portion 190 with a corresponding second channel portion 192 such that each strap 142 may be threaded through the turnbuckle 140 in extending within corresponding first and second channel portions 190, 192 (see FIG. 3), as explained below. In one embodiment, each second channel portion 192 is defined, at least in part, by a tab 230 extending from a portion of the front surface 200 of the turnbuckle 140, though other configurations are contemplated including without limitation a configuration similar to the first channel portion 190. In like manner, the first channel portion 190 may be configured similar to the second channel portion 192, namely defined by a tab or other structure extending from the rear surface 202. In each embodiment described herein, the first and second channel portions 190, 192 may facilitate smooth operation of the strap(s) 142, such as permitting each strap 142 to slide through the turnbuckle 140 (through the first and second channel portions 190, 192) with relative ease or freedom. In some embodiments, the first and second channel portions 190, 192 may be configured to limit movement of each strap 142 relative to the turnbuckle 140, which may be beneficial to maintain a secure holding arrangement around the object 112. In some embodiments, the turnbuckle 140 may be dimensioned such that it is considered thin. As explained below, the securing arrangement 110 may be configured to limit movement of the turnbuckle 140 relative to the rear panel 132. For example without limitation, the turnbuckle 140 may be coupled (releasably or fixedly) to the rear panel 132, such as to a central portion of the rear panel 132. As described below, the turnbuckle 140 may be adjusted relative to the rear panel 132 to accommodate and secure objects of various sizes and shapes.

Referring to FIG. 3, each strap 142 may be routed through corresponding first and second channel portions 190, 192 of the turnbuckle 140. For example, the first strap 180 may be routed through a corresponding first channel portion 190 from the right edge 206 of the turnbuckle 140 to an associated slot 220, at which point the first strap 180 extends through the slot 220 from the rear surface 202 of the turnbuckle 140 to the front surface 200. In some embodiments, the first portion 160 of the first strap 180 may be positioned within the first channel portion 190 between the rear panel 132 and at least a portion of the turnbuckle 140. For example, in embodiments where the rear surface 202 of the turnbuckle 140 is attached directly to the rear panel 132, the first portion 160 of the first strap 180 may be positioned to slide within the first channel portion 190 between (e.g., against) the rear panel 132 and the turnbuckle 140.

After extending through the slot 220, the first strap 180 may be routed through a corresponding second channel portion 192 (e.g., along the front surface 200) from the slot 220 towards the top edge 208 of the turnbuckle 140. At least a portion of the first strap 180 may be positioned between the front surface 200 of the turnbuckle 140 and the tab 230 extending therefrom to secure the first strap 180 within the second channel portion 192. After extending through the second channel portion 192, the second portion 162 of the first strap 180 may be secured (e.g., releasably secured) to another portion of the securing arrangement 110, such as to the front panel 130. Similarly, before extending through the first channel portion 190, the first portion 160 of the first strap 180 may be anchored to the front panel 130. As shown, the arrangement of the first and second channel portions 190, 192 and the slot 220 may effectively turn or direct the first strap 180 through the angle $\alpha$, such as from horizontal to vertical. In one embodiment, the arrangement of the first and second channel portions 190, 192 and the slot 220 may fold the first strap 180 through the turnbuckle 140 to limit binding of the first strap 180 through the turnbuckle 140, for example. The second strap 182 may be routed through the turnbuckle 140 in a similar manner, albeit from the left edge 204 of the turnbuckle 140, through separate first and second channel portions 190, 192, and towards the top edge 208 of the turnbuckle 140 in a mirrored configuration to the first strap 180.

The configuration of the turnbuckle 140 described herein facilitates simultaneous adjustment of the first and second portions 160, 162 of each strap 142 relative to the turnbuckle 140. For example, as explained below, the first and second portions 160, 162 may be adjusted simultaneously relative to the turnbuckle 140 by a user pulling the distal end 163 of each strap 142 to secure or release the object 112 between the front and rear panels 130, 132. In a preferred embodiment, the second portion 162 is adjusted simultaneously with the first portion 160 around the object 112 to secure or release the object 112 between the front and rear panels 130, 132. In further example, moving (e.g., pulling) the distal end 163 of each strap 142, such as via the flap 168, may tighten each strap 142 against at least one side of the object 112. Additionally or alternatively, pulling the distal end 163 of each strap 142 may move (e.g., compress, pull, etc.) at least one of the front and rear panels 130, 132 against the object 112. For example, pulling the distal end 163 of each strap 142 may move the front and rear panels 130, 132 towards each other and against the object 112. The distal ends 163 of each strap 142 may be joined together and attached together (such as releasably attached) to the front panel 130. For example, the distal ends 163 of the first and second straps 180, 182 may be joined together at the flap 168. In such embodiments, pulling the flap 168 may simultaneously move the distal ends 163 of each strap to adjust the first and second straps 180, 182 relative to the turnbuckle 140 and/or the object 112.

Figure 4:
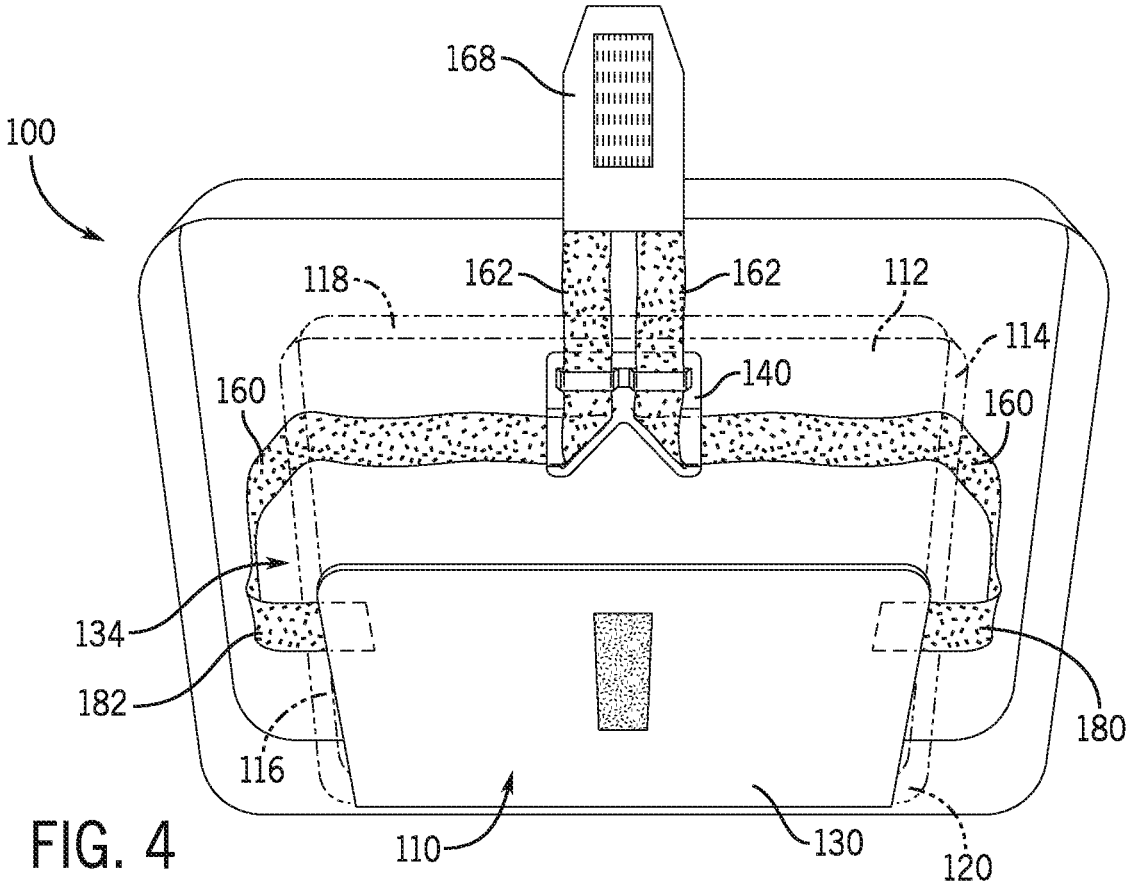
FIG. 4 is a front isometric view of the luggage article of FIG. 1 and showing securement members extending loosely around a first laptop (shown in phantom) and through the adjustment mechanism of FIG. 3 in accordance with some examples of the present disclosure. The front wall of the luggage article is removed for illustration purposes only.
Figure 5:
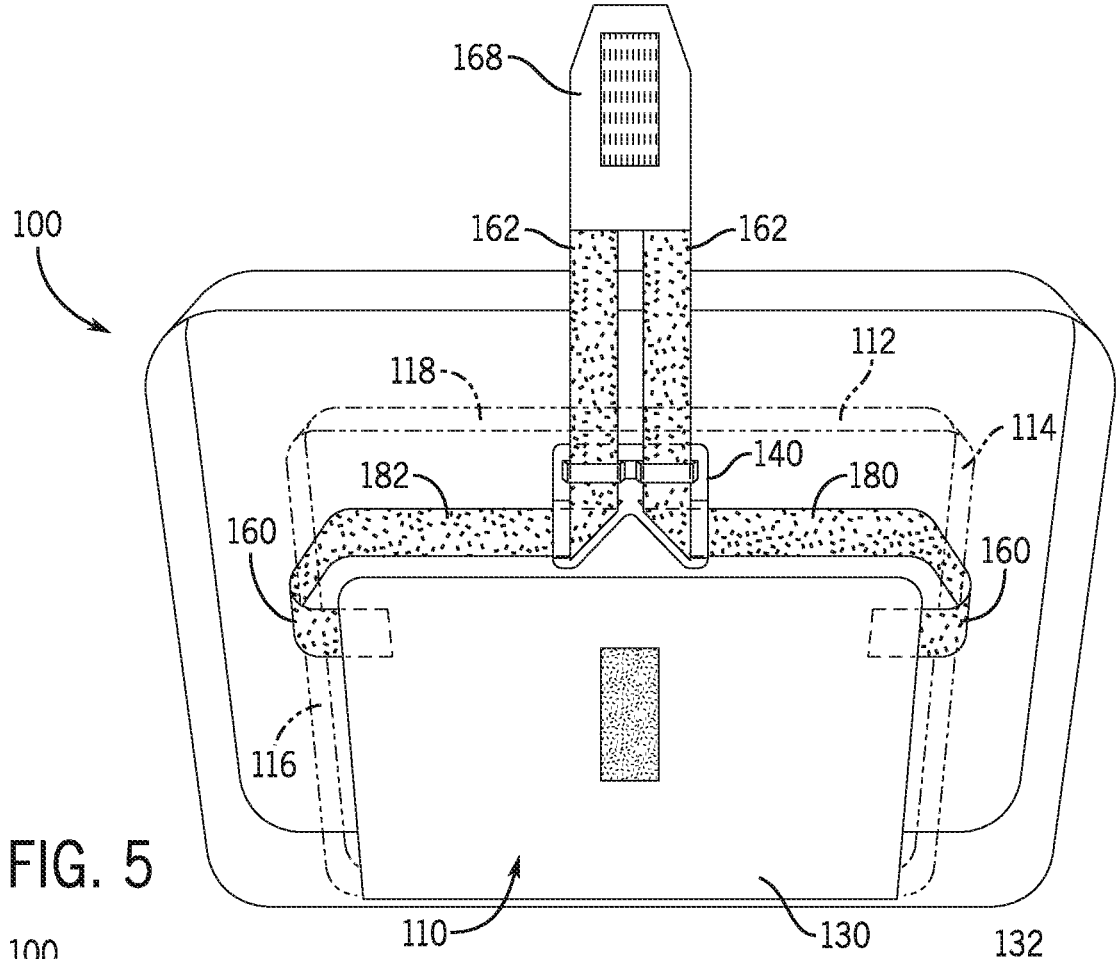
FIG. 5 is a front isometric view of the luggage article of FIG. 1 and showing the securement members tightened against the sides of the first laptop (shown in phantom) in accordance with some examples of the present disclosure. The front wall of the luggage article is removed for illustration purposes only.
Figure 6:
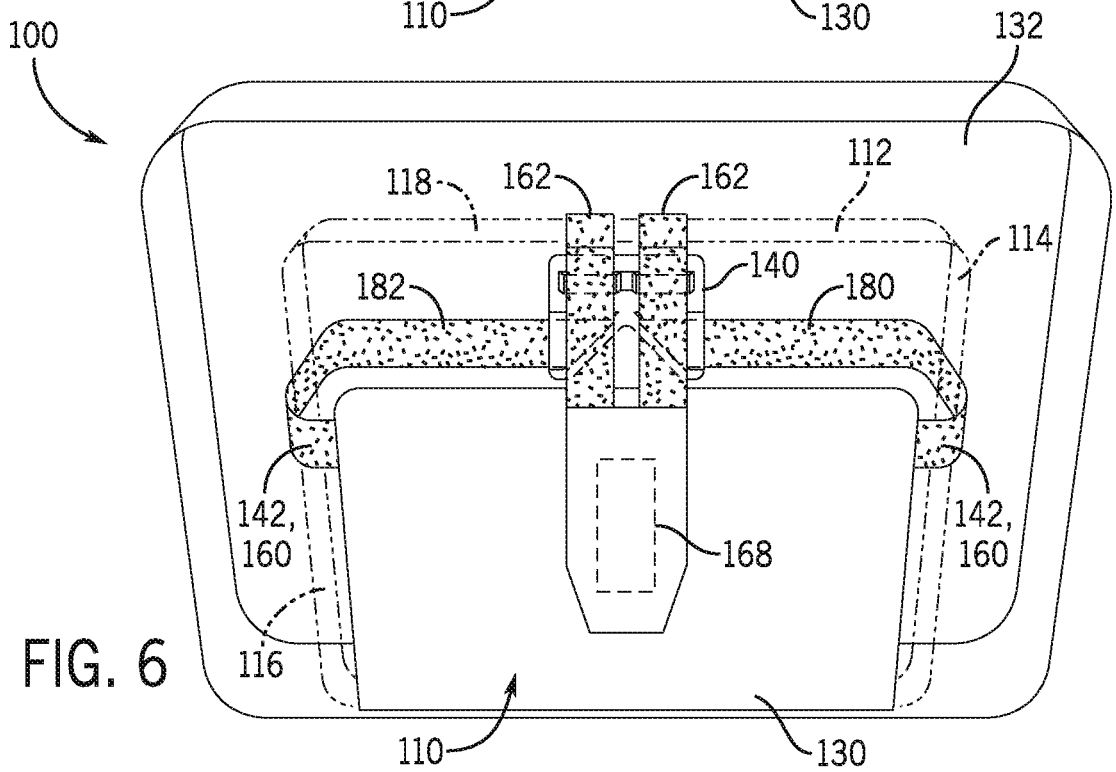
FIG. 6 is a front isometric view of the luggage article of FIG. 1 and showing the securement members tightened against adjacent sides of the first laptop (shown in phantom) to secure the laptop within the luggage article in accordance with some examples of the present disclosure. The front wall of the luggage article is removed for illustration purposes only.

More specifically, with reference to FIGS. 4-6 in order, the object 112 may be positioned at least partially between the front and rear panels 130, 132 of the securing arrangement 110, such as by inserting at least a portion of the fourth side 120 of the object 112 within the space 134 defined between the front and rear panels 130, 132. As shown in FIG. 4, the first and second straps 180, 182 may extend loosely around the object 112 to allow the object 112 to be at least partially inserted between the front and rear panels 130, 132. Once the object 112 is positioned between the front and rear panels 130, 132, the flap 168 may be moved (e.g., pulled), such as upwardly, to extend the flap 168 and the distal ends 163 of the second portions 162 of the first and second straps 180, 182 away from the object 112.

As the flap 168 is pulled away from the object 112, increasing lengths of the first and second straps 180, 182 may slide through the first channel portions 190, through the slots 220, and through the second channel portions 192 of the turnbuckle 140, thereby increasing the lengths of the second portions 162 and decreasing the lengths of the first portions 160 of the first and second straps 180, 182. This in turn simultaneously tightens the first and second straps 180, 182 (e.g., the first portions 160 of the first and second straps 180, 182) against the object 112, such as against the opposing first and second sides 114, 116 of the object 112 (see FIG. 5). In addition, because the first and second straps 180, 182 (e.g., the first portions 160 of the first and second straps 180, 182) are anchored to the front panel 130 and because the turnbuckle 140 is coupled to the rear panel 132, pulling the flap 168 away from the object 112 simultaneously pulls the front and rear panels 130, 132 towards each other and towards the object 112. The flap 168 may be pulled away from the object 112 until, for example, the front and rear panels 130, 132 abut the object 112 and/or the first portions 160 of the first and second straps 180, 182 are tightened against corresponding sides of the object 112 (see FIG. 5).

Once the front panel 130, the rear panel 132, and the first portions 160 of the first and second straps 180, 182 are tightened against the object 112, the distal ends 163 of the first and second straps 180, 182 may be releasably attached to the front panel 130, such as via the flap 168. For instance, as shown in FIG. 6, the flap 168 may be directed toward the front panel 130 to extend the second portions 162 of the first and second straps 180, 182 over the top of the object 112 and against the third side 118 of the object 112. The flap 168 may then be attached and secured to the front panel 130, such as via the hook-and-loop fastener described above, to secure the object 112 within the securing arrangement 110 (see FIG. 6). Once secured, the object 112 may be positioned at least partially between the front and rear panels 130, 132, between the first portions 160 of the first and second straps 180, 182, and between one of the walls of the luggage article 100 and the second portions 162 of the first and second straps 180, 182.

Removal of the object 112 from the securing arrangement 110 may be accomplished in substantially reverse order. In particular, the flap 168 may first be disengaged from the front panel 130 to allow reverse movement of the first and second straps 180, 182 through the turnbuckle 140. For example, once the flap 168 disengages the front panel 130, the first portion 160 of at least one of the first and second straps 180, 182 may be moved (e.g., pulled) away from the turnbuckle 140, such as via a user pulling the first portion(s)

160 outwardly away from the object 112 and/or pulling the front panel 130 away from the object 112. For example, a user may alternate between loosening the first strap 180 and loosening the second strap 182, or simply loosen one of the first and second straps 180, 182. In each example above, moving the first portion 160 of at least one of the first and second straps 180, 182 away from the turnbuckle 140 pulls increasing lengths of at least one of the first and second straps 180, 182 through the turnbuckle 140, thereby increasing the length of the first portion 160 and decreasing the length of the second portion 162 of the strap, thereby loosening at least one of the first and second straps 180, 182 simultaneously from one or more sides of the object 112. Once the first and second straps 180, 182 are sufficiently loosened, the object 112 may be released from the securing arrangement 110.

Figure 7:
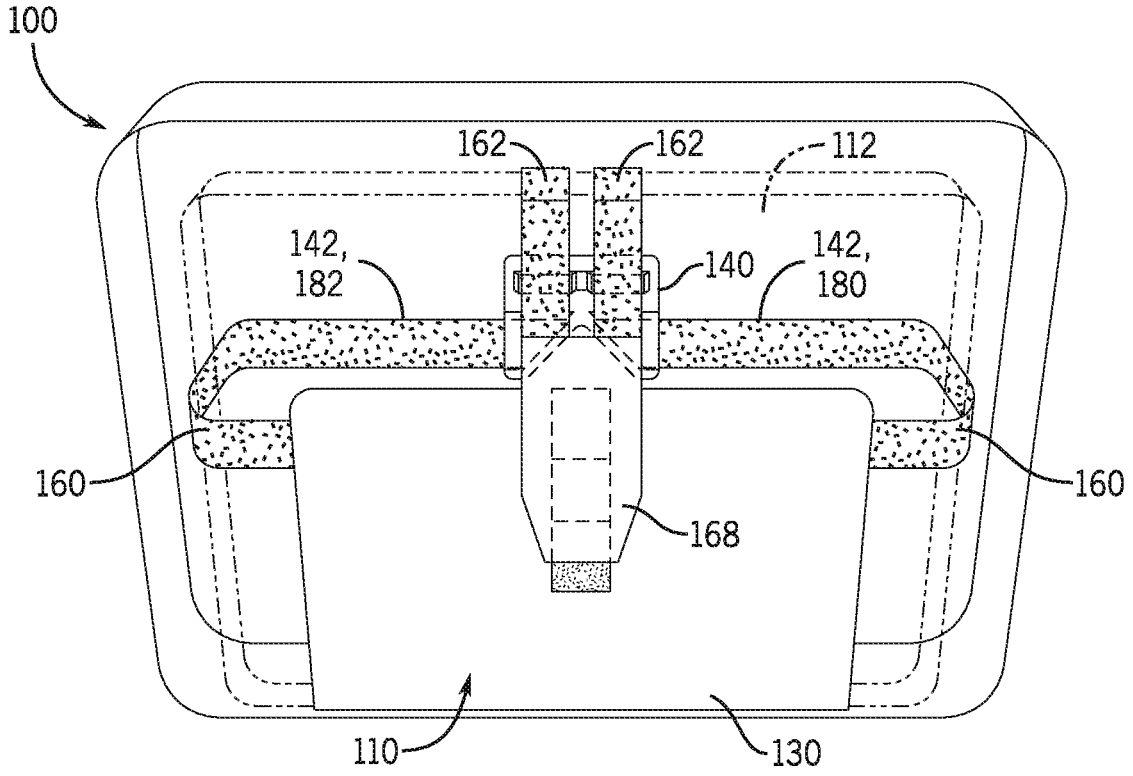
FIG. 7 is a front isometric view of the luggage article of FIG. 1 and showing the adjustable securing arrangement securing a second, larger laptop (shown in phantom) within the luggage article in accordance with some examples of the present disclosure. The front wall of the luggage article is removed for illustration purposes only.

According to the present disclosure, the securing arrangement 110 may be configured to secure objects of various shapes and sizes within the luggage article 100. For example, in comparing FIGS. 6 and 7, the securing arrangement 110 may be adjusted to accommodate objects of smaller or larger dimensions. For example, for larger objects, the lengths of the first portions 160 relative to the lengths of the second portions 162 may increase such that less of the first and second straps 180, 182 extends over the front panel 130 in securing the flap 168 to the front panel 130 (see FIG. 7). For smaller objects, the lengths of the first portions 160 relative to the lengths of the second portions 162 may decrease such that more of the first and second straps 180, 182 extend over the front panel 130 in securing the flap 168 to the front panel 130 (see FIG. 6). The same comparisons can be true for wider versus narrower objects, taller versus shorter objects, and/or thicker versus skinnier objects. In some embodiments, the flap 168 may be omitted such that the first and second straps 180, 182 may be individually controlled to accommodate oddly-shaped objects, such as objects wherein the first side 114 is smaller than the second side 116 (e.g., a binder).

Figure 10:
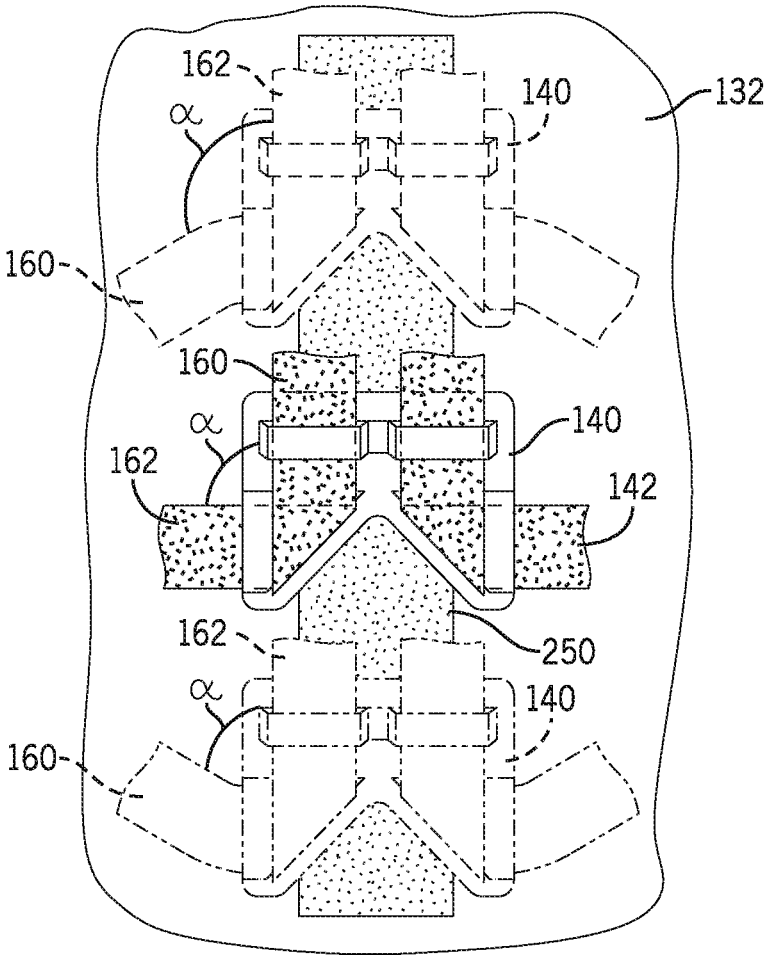
FIG. 10 is a fragmentary view of the adjustment mechanism of FIG. 3 adjustably and/or releasably coupled to a portion of the adjustable securing arrangement in accordance with some examples of the present disclosure.

In some embodiments, the turnbuckle 140 may be adjustably coupled to the rear panel 132 to tailor the securing characteristics of the securing arrangement 110 (e.g., to accommodate objects of varying sizes). In one embodiment, illustrated in FIG. 10, the turnbuckle 140 may be coupled to the rear panel 132 via a hook-and-loop fastener 250. Similar to the releasable attachment of the flap 168 with the front panel 130, the arrangement of the hook-and-loop fastener 250 between the rear panel 132 and the turnbuckle 140 may allow the turnbuckle 140 to be releasably coupled to the rear panel 132 at any one of a plurality of positions. In such embodiments, placement of the turnbuckle 140 relative to the rear panel 132 may affect how the turnbuckle 140 directs each strap 142. For example, as shown in FIG. 10, moving the turnbuckle 140 upwards may increase the angle $\alpha$ between the first and second portions 160, 162 of each strap 142, which will have the tendency to bias the turnbuckle 140 downwards without a complimentary upward force provided by either the second portions 162 of the first and second straps 180, 182, the hook-and-loop fastener 250, or both. Similarly, moving the turnbuckle 140 downwards may decrease the angle $\alpha$ between the first and second portions 160, 162 of each strap 142, which will have the tendency to bias the turnbuckle 140 upwards without a complimentary downward force provided by the hook-and-loop fastener 250.

Figure 11:
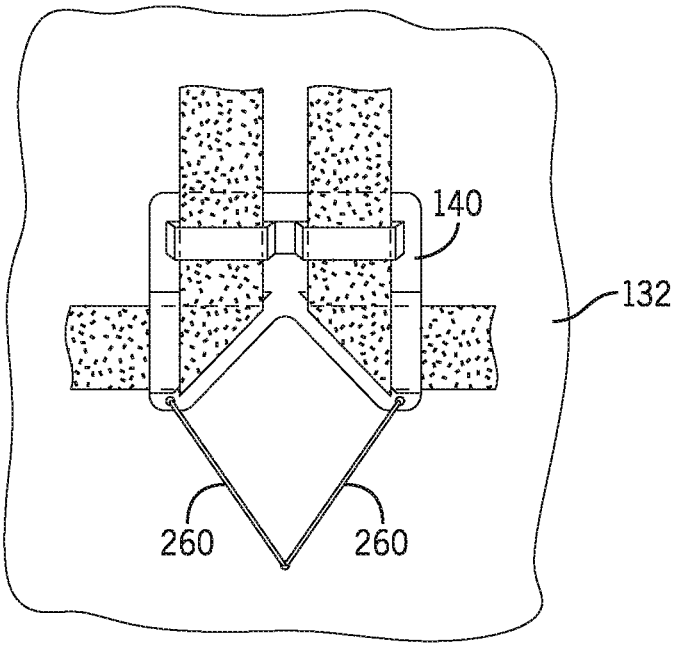
FIG. 11 is a fragmentary view of the adjustment mechanism of FIG. 3 coupled to a portion of the adjustable securing arrangement in accordance with other examples of the present disclosure.

Though the turnbuckle 140 is preferably coupled to the rear panel 132 to limit movement of the turnbuckle 140 relative to the rear panel 132, in some embodiments the turnbuckle 140 may be coupled to the rear panel 132 in a manner that allows at least some extent of movement of the turnbuckle 140 relative to the rear panel 132. For example, in one embodiment, illustrated in FIG. 11, the turnbuckle 140 may be coupled to the rear panel 132 via one or more cords 260. In such embodiments, the one or more cords 260 may define the extent of movement of the turnbuckle 140 relative to the rear panel 132. In some embodiments, the one or more cords 260 may be adjustable (e.g., selectively lengthened or shortened) to permit a user to define the extent of movement of the turnbuckle 140 relative to the rear panel 132. In this manner, the turnbuckle 140 may be positioned at various locations relative to the rear panel 132, which may be beneficial depending on the size and/or shape of the object to be secured within the luggage article 100.

As noted above, the luggage article 100 may be substantially any luggage piece or article. In the specific embodiment of FIGS. 1 and 2, the luggage article 100 includes a rear wall 300, an opposing front wall 302, and a plurality of side walls 304 extending between the front and rear walls 302, 300, such as opposing top and bottom walls 306, 308 and opposing left and right walls 310, 312, that collectively define the housing 102. In such embodiments, the rear panel 132 of the securing arrangement 110 may at least partially define one of the front and rear walls 302, 300 (e.g., the rear wall 300) of the housing 102. In some embodiments, the front panel 130 of the securing arrangement 110 may be hingedly coupled to one of the walls of the housing 102. For example and without limitation, the front panel 130 may be hingedly coupled to the rear wall 300 and/or to the bottom wall 308. In one embodiment, portions of the luggage article 100, such as at least portions of the side walls 304, may be padded to limit damage of the object 112 during transit. Additionally or alternatively, the luggage article 100 may include a padded insert 314 positioned within the internal storage compartment 104 of the luggage article 100 (see FIG. 2). The padded insert 314, which may be formed from foam or other resiliently deformable material, may extend adjacent the side walls 304 of the luggage article 100. In such embodiments, the padded insert 314 may substantially surround the sides of the object 112 to protect the object 112 during transit and/or limit movement of the object 112 relative to the front and rear panels 130, 132 of the securing arrangement 110.

In the embodiment of at least FIG. 1, the luggage article 100 may be a briefcase. However, it is contemplated the luggage article 100 may be an upright spinner case 320 (see FIG. 8) or a backpack 330 (see FIG. 9), among others. In embodiments where the luggage article 100 is an upright spinner case 320, the luggage article 100 includes a plurality of wheel assemblies 340 (e.g., four spinner wheel assemblies) coupled thereto, such as to the bottom wall 308, to permit the upright spinner case 320 to traverse across a support surface. Additionally or alternatively, the upright spinner case 320 may be a split case including a base 350 and a lid 352 pivotably coupled to the base 350. In such embodiments, the securing arrangement 110 may be associated with the lid 352 of the upright spinner case 320, in which case the rear panel 132 of the securing arrangement 110 at least partially defines the front wall 302 of the case.

The luggage article 100 and/or securing arrangement 110 may be formed from a variety of materials and means. For example, the luggage article 100 and at least portions of the securing arrangement 110 may be moldable hard side material, soft side material, or a combination of hard side material and soft side material. The hard side material may be a thermoplastic material (self-reinforced or fiber reinforced), ABS, polycarbonate, polypropylene, polystyrene, PVC, polyamide, and/or PTFE, among others. The luggage article 100 may be formed or molded in any suitable manner, such as by plug molding, blow molding, injection molding, or the like. The softside material may be nylon, canvas, polyester, leather, PVC, polypropylene, polyethylene, and/or PTFE, among others.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. An adjustable securing arrangement configured to secure an object within a luggage article, the adjustable securing arrangement comprising:

opposing front and rear panels defining a space therebetween configured to position the object;

a buckle coupled to at least one of the front and rear panels; and at least one flexible strap extending from one of the front and rear panels and at least partially through the buckle to then be releasably secured by a fastener to the one of the front and rear panels, each strap comprising a first portion arranged to extend around at least one side of the object and a second portion arranged to extend over a top side of the object, the buckle redirecting each strap via a channel portion such that the first portion extends at an angle (α) to the second portion, the first portion and the second portion adjusted simultaneously relative to the buckle by a user pulling a distal end of each strap to secure or release the object between the front and rear panels, wherein: the channel portion of the buckle comprises at least one first channel portion and at least one second channel portion defined therein.

2. The adjustable securing arrangement of claim 1, wherein the buckle directs each strap through the angle (α) to position each strap around adjacent sides of the object.

3. The adjustable securing arrangement of claim 1, wherein:

the buckle is coupled to the rear panel; and each strap extends from the front panel with a distal end of each strap releasably attached to the front panel.

4. The adjustable securing arrangement of claim 3, wherein the rear panel is formed as part of the luggage article.

5. The adjustable securing arrangement of claim 3, wherein the front panel is a flap-like member extending from adjacent the bottom of the object.

6. The adjustable securing arrangement of claim 1, wherein each strap is at least partially resiliently extendable.

7. The adjustable securing arrangement of claim 1, wherein pulling the distal end of each strap tightens each strap against at least one side of the object and moves at least one of the front and rear panels against the object.

8. The adjustable securing arrangement of claim 1, wherein the angle (α) at which the first portion extends relative to the second portion is a perpendicular angle.

9. The adjustable securing arrangement of claim 1, wherein each strap comprises two straps, the first portion of each strap at least partially extending in respective opposing directions around opposing sides of the object.

10. The adjustable securing arrangement of claim 9, wherein the distal ends of each strap are joined together and attached together to the front panel.

11. The adjustable securing arrangement of claim 1, wherein:

first and second channel portions extend at the angle (α) relative to each other;

the first portion of each strap extends within the first channel portion; and the second portion of each strap extends within the second channel portion to direct the first and second portions of each strap through the angle (α).

12. The adjustable securing arrangement of claim 11, wherein a slot is defined through the buckle to connect first and second channel portions defined on opposing sides of the buckle together, each strap threaded through a slot in extending within the first and second channel portions.

13. A luggage article comprising the adjustable securing arrangement of claim 1, the luggage article comprising:

a housing defining an internal storage compartment, and including:

a rear wall;

a front wall opposite the rear wall;

a plurality of side walls extending between the front and rear walls; and an opening allowing access to the internal storage compartment wherein the adjustable securing arrangement is associated with the housing to adjustably secure the object within the internal storage compartment.

14. The luggage article of claim 13, wherein the rear panel of the adjustable securing arrangement comprises at least part of the rear wall of the housing.

15. The luggage article of claim 13, wherein the front panel of the adjustable securing arrangement is hingedly coupled to one of the walls of the housing.

16. The luggage article of claim 13, wherein the front panel of the adjustable securing arrangement is hingedly coupled to the rear wall of the housing or to a bottom wall of the housing.

* * * * *